US005871191A

United States Patent [19]

Cohn

[11] Patent Number: 5,871,191

[45] Date of Patent: Feb. 16, 1999

[54] ADJUSTABLE MOUNTING BRACKET

[76] Inventor: Sidney L. Cohn, 7824 W. 99th St., Overland Park, Kans. 66212

[21] Appl. No.: 808,192

[22] Filed: Feb. 28, 1997

Related U.S. Application Data

[63] Continuation of Ser. No. 657,007, May 28, 1993, abandoned, which is a continuation of Ser. No. 964,281, Oct. 21, 1992, abandoned.

[51] Int. Cl.[6] ..... A47G 29/02

[52] U.S. Cl. ..... 248/242; 108/9; 248/288.21

[58] Field of Search ..... 248/240, 242, 248/288.31, 351; 108/1, 6, 7, 9; 211/150

[56] References Cited

U.S. PATENT DOCUMENTS

| | | | |
|---|---|---|---|
| 2,564,935 | 8/1951 | Templeton | 248/242 |
| 3,114,531 | 12/1963 | Weber | 248/242 |
| 3,776,498 | 12/1973 | Peters et al. | 248/242 X |
| 4,709,892 | 12/1987 | Gurgui | 248/242 |
| 5,076,648 | 12/1991 | Makainai | 248/242 X |

FOREIGN PATENT DOCUMENTS

| | | | |
|---|---|---|---|
| 652197 | 3/1929 | France | 248/242 |
| 224092 | 11/1924 | United Kingdom | 248/242 |

*Primary Examiner*—Kenneth E. Peterson
*Attorney, Agent, or Firm*—Graham & James LLP

[57] ABSTRACT

An adjustable mounting bracket for the installing of a level table surface by use of an adjustable mounting system. The wall mounting bracket includes a bracket having a wall end and a table end and an adjustable bracket system for the bracket on the wall. An adjustable table mounting bracket is provided for mounting a level table on the bracket, even where the wall is not true or perpendicular to the floor.

3 Claims, 2 Drawing Sheets

ADJUSTABLE MOUNTING BRACKET

This is a continuation of application Ser. No. 08/657,007 filed May 28, 1996, now abandoned, which is a continuation of application Ser. No. 07/964,281 filed Oct. 21, 1992, now abandoned.

FIELD OF THE INVENTION

This invention relates generally to the field of home and commercial furniture, and more particularly to a method and apparatus for mounting a table top to a wall by use of an adjustable mounting bracket.

BACKGROUND OF THE INVENTION

In home, restaurant and commercial design applications, tables and counters are frequently cantilevered from a wall or other vertical surface by mounting the table or counter top on a wall bracket. For example, in many restaurants using booth seating arrangements, it is typical to find the eating table cantilevered from a wall. One of the advantages of such a design construction is that it eliminates the table pedestal or base from interfering with the user's legs and feet while sitting at the table. A further advantage of a cantilever table system is that in cleaning, it is possible to mop or sweep directly under the table without having to maneuver around table legs or a pedestal.

While table top cantilever systems have become well-known and widely used in various industrial and commercial applications, the systems are based on brackets that require the wall or support surface to be true to perpendicular. That is, one portion of the bracket is mounted onto the wall and a portion upon which a table top may be affixed extends outward at a right angle therefrom. Exemplary is a right angle wall mount bracket, one side of which mounts to the wall, and the other side of which extends perpendicularly outward from the wall. The table or counter top is mounted on the side extending from the wall. Another existing bracket used to cantilever mount a table on a wall is a bracket that has a middle portion angling between two perpendicular portions. Such a bracket also requires that the wall and table be perpendicular to one another.

Even in new building facilities, however, it is not uncommon for a wall to be slightly deviated from perpendicular to the ground. Accordingly, wall mounting systems frequently result in a table top being mounted at an angle which is perpendicular to the wall, but which is not necessarily a true or level angle. Because the table top is uneven, objects may slide when placed thereon. In the past, the installer would "shim" the table top by placing a thin piece of wood or metal (commonly called a "shim") between either the wall and the bracket or the table top and the bracket. The shim serves to level the surface of the table top. Other less frequently used methods of leveling the table top include actually bending the bracket to fit the wall and planing the underside of the table top or wall. Such approaches are not only quite time consuming and difficult and with respect to bending the mounting brackets, may result in metal fatigue.

SUMMARY OF THE INVENTION

The adjustable mounting bracket of the present invention meets the functional requirements as discussed above in the Background Of The Invention in providing a level table top or counter surface without the use of either a shim or the bending and stressing of the bracket system itself.

Generally stated, the adjustable mounting bracket of the present invention provides for the installing of a level table surface by use of an adjustable mounting system. More specifically, the wall mounting bracket of the present invention includes a bracket having a wall end and a table end. The bracket also includes a means for mounting the bracket on the wall, and a table means for mounting a level table on the bracket, even where the wall is not true or perpendicular to the floor.

In the preferred embodiment, the means for mounting comprises a screw assembly for securely affixing the wall bracket to the wall surface. The table means is preferably an adjustable screw assembly and mounting plate that can be raised or lowered as the particular application requires. The underside of the table top can then be securely affixed to the bracket in a true or level position.

BRIEF DESCRIPTION OF THE DRAWINGS

The invention will be described with reference to the accompanying drawings, wherein.

DESCRIPTION OF THE PREFERRED EMBODIMENT

The following description is of the best presently contemplated mode of carrying out the invention. This description is made for the purpose of illustrating the general principles of the invention, and is not to be taken in a limiting sense. Exemplary is the fact that, although the invention is described with reference to a sitting booth table top, the invention may be utilized in other applications were a cantilever wall bracket system is utilized. The scope of the invention is best determined by reference to the appended claims.

Figure 1:
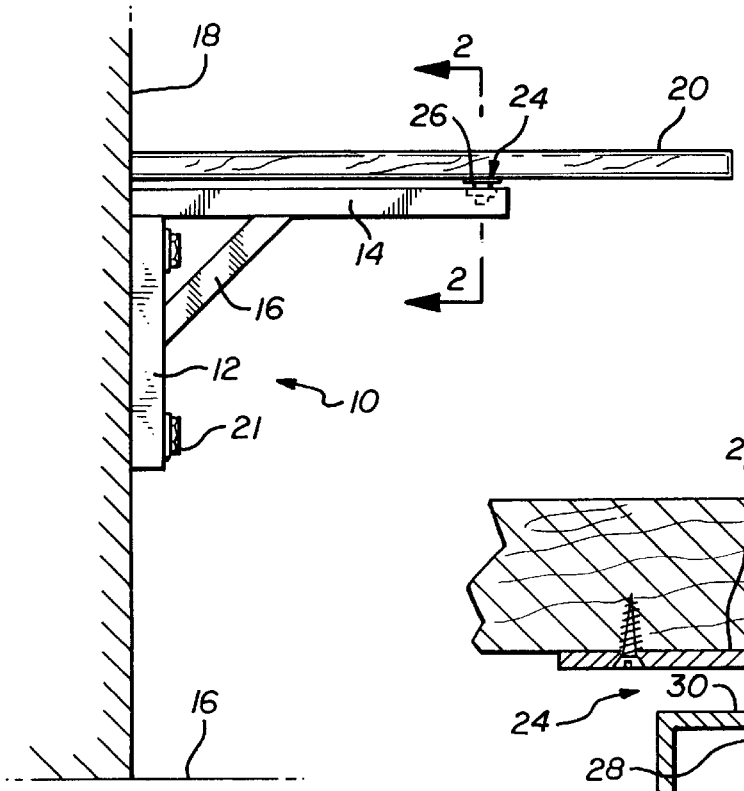
FIG. 1 is a side view of a table mounted on a wall with the adjustable mounting bracket of the present invention.

Referring to FIG. 1, FIG. 1 is a side view of the adjustable mounting bracket of the present invention (as generally indicated by reference numeral 10). Adjustable mounting bracket 10 has a wall leg 12 and a table support leg 14. Wall leg 12 and table support leg 14 are positioned at a right angle and include a bracket brace 16 extending therebetween. Wall leg 12 is securely affixed to a wall 18 or other vertical partition or support. The method of fixation is only limited by the structural and weight requirements of the table 20. By way of example, but not of limitation, bolt assembly system 21 may be introduced into holes in wall leg 12 and wall leg 12 securely attached to wall 18.

Figure 2:
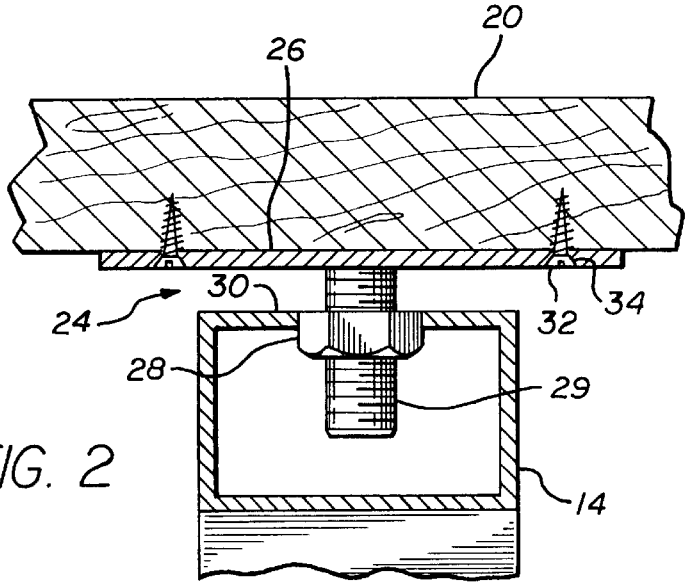
FIG. 2 is a cross-sectional view of a table mounted on a wall with an adjustable mounting bracket of the present invention taken along plane 2—2 of FIG. 1.

With reference to table support leg 14, an adjustable table support 24 is positioned toward the end of table support leg 14 (best when in FIG. 2). Referring to FIG. 2, a cross-sectional view of the present invention, adjustable table support 24 includes a support plate 26 and a engaging stem 29 extending downward therefrom. Engaging stem 29 is shown in the preferred embodiment to be a threaded member which is matingly engagable with a nut 28 positioned adjacent the upper surface 30 of table support leg 14. Support plate 26 may be raised or lowered as is required to affix table top 20 in a level orientation from wall 18. Table top 20 may be affixed to support surface 24 by use of screws 34 through apertures 36 in support plate 26. Support leg 14 of bracket 10 is shown in FIG. 2 to have a rectangular cross-sectional configuration, but it should be appreciated that a variety of shapes, for example, circular or square may be utilized for any portion of bracket 10.

Figure 3:
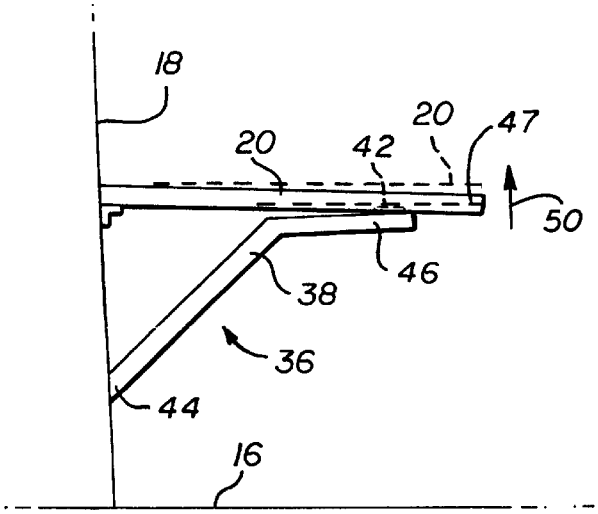
FIG. 3 PRIOR ART
FIG. 3 is a side view of a table mounted on a wall using a prior art mounting bracket.

In order to better illustrate the present invention, a prior art table bracket is shown in FIG. 3. Prior art bracket (generally indicated by reference numeral 36) includes a support arm 38 and a mounting bracket 42 which is permanently affixed (typically by welding) to table end 46 a support arm 38. Support arm 38 is attached to wall 18 at a wall end 44 and to the bottom of the table 20 at a table end 46. As shown in FIG. 3, wall 18 is slightly angled from perpendicular to floor 16 and thus table end 46 is not true or level. The result is that when table top 20 is attached to wall 18 by mounting surface 42, the outer end 47 of table top 20 will be inclined toward the floor 16. In order to level table top 20 in existing designs (as shown in ghost lines), it is necessary to use a shim (not shown). A shim is placed between the under side of outer end 47 of table top 20 and mounting surface 49 is table end 46, thereby raising (as shown by directional arrow 50) the outer end 47 of table top 20. The desired end position of table top 20 to level or true is shown by the ghost lines in FIG. 3.

Figure 4:
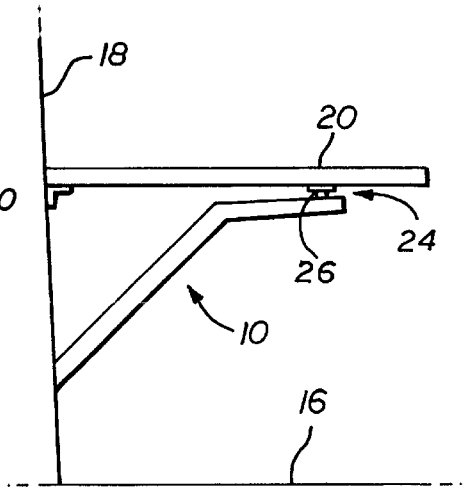
FIG. 4 is a side view of an alternative embodiment of the adjustable mounting bracket of the present invention.

In contrast to the requirement of using a shim 5, or to bending bracket 38 or adding or removing part of wall 18 where mounting bracket 38 is affixed to wall 18, the present invention eliminates the need to physically alter either the bracket, wall or table. As shown in FIG. 4, the same angle in wall 18 as is shown in FIG. 3 may be compensated for by raising support plate 26 of adjustable table support 24. Engaging stem 29 rotationally extends as support plate 26 is moved upward from table support leg 14. Once table top 20 is level, support plate 26 may be securely attached to table top 20. It should be appreciated that in certain applications, wall 18 will be in a true perpendicular orientation such that the cantilevered table top will be level when placed directly upon a right angle bracket. Accordingly, when support plate 26 is in a completely retracted position, table top 20 may be placed thereon without the need to raise support plate 26.

Figure 5:
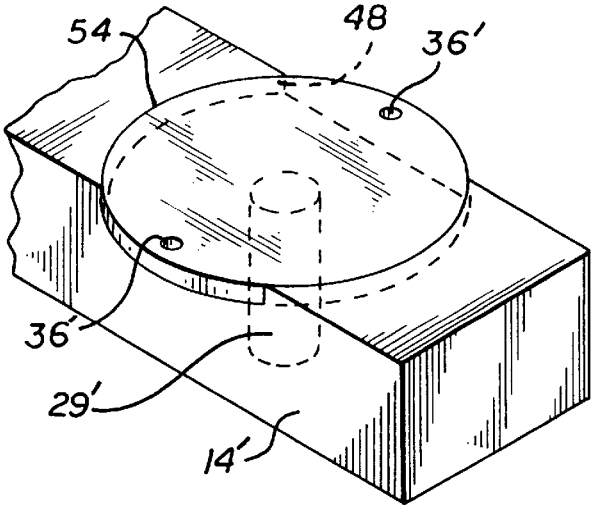
FIG. 5 is a partial perspective view of an alternative embodiment of the adjustable mounting bracket of the present invention.

In another embodiment of the present invention as shown in FIG. 5, table support leg 14' includes a depressed area 54 which is capable of receiving support plate 26'. When wall 18 is at a true perpendicular to floor 16, support plate 26' is completely retracted and table top 20 is level when resting directly upon table support leg 14'. When wall 18 is disoriented from perpendicular, however, support plate 26' may be rotatably raised out of depression area 54 until table top 20 is in a level position. Once level, table top 20 may then be secured to support plate 26' through screw aperatures 36'.

In order to facilitate leveling of table top 20 and the manipulation of support plate 26', support plate 26' is mounted on top of engaging stem 28' by a socket assembly 56. Socket assembly 56 permits support plate 26' to slightly incline as required by table top 20 during leveling. Further (for example as best shown in FIG. 7), socket assembly 56 enables the raising and lowering of support plate 26' into depression 54 which is of a size that will permit the complete rotation of support plate 26'.

Figure 6:
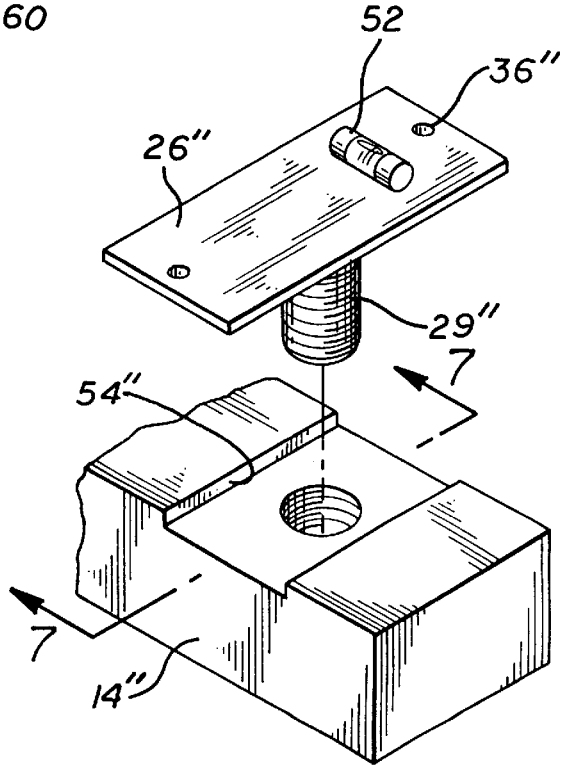
FIG. 6 is a partial perspective view of an alternative embodiment of the adjustable mounting bracket of the present invention.

Turning to address FIG. 6, FIG. 6 shows a second alternative embodiment of the present invention. In FIG. 6, engaging stem 28" extends all the way through table support leg 14" to mate with both a first bolt 58 and a second bolt 60 (as best shown in FIG. 7). The configuration of surface plate 26" in this embodiment permits surface plate 26" to be secured to engaging stem 29" and still permit surface plate 26" to be lowered into depression 54" without being independently rotatable. Also shown in FIG. 6. is a separate level device 52 for determining the relative horizontal orientation of surface plate 26" and table support leg 14".

Figure 7:
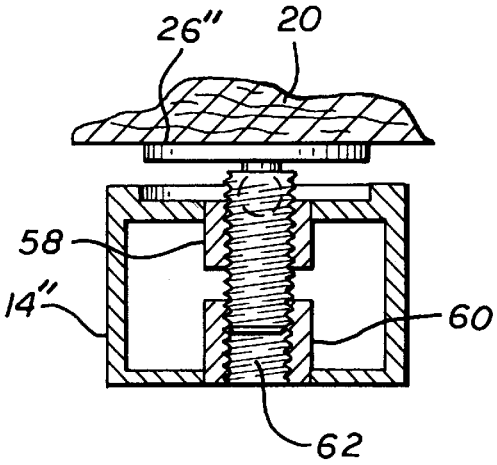
FIG. 7 is a cross-sectional view of the alternative embodiment of the adjustable mounting bracket of the present invention taken along plane 7—7 of FIG. 6.

As exemplified in FIG. 7, a cross-sectional view through plane 7—7 of FIG. 6, it is possible to adjust the height of support plate 26" without removing table top 20. Engaging stem 29", and consequently surface plate 26", may be raised and lowered through the use of an alan wrench or similar tool which is accessed through aperature 62. This embodiment also permits table top 20 to be placed directly upon support plate 26" when the leveling is being completed. This second alternative embodiment enables the installation and leveling of table top 20 without the continual necessity of removing and replacing table top 20 in order to raise or lower support plate 26" to achieve a level resting surface. It should also be appreciated that engaging stem 29" may be attached to support plate 26" in such a manner, e.g., by use of a pivoting socket relationship, that rotation of engaging stem 29" (and the consequent raising and lowering of support plate 26") does not cause support plate 26" to rotate. In such an attachment method, support plate 26" may be affixed to the bottom surface of table top 20 through the use of holes 36" and then the final adjustments made. This arrangement also permits the adjusting of table top 20 after installation should the same be desirable. Having detailed the preferred embodiment, and alternative embodiments, of the present invention, it will be appreciated that further alternative embodiments and configurations will be apparent to those skilled in the art. Accordingly, it is expected that the proper scope of the present invention will be best determined by reference to the appended claims.

I claim:

1. A wall bracket system for mounting a table top having top and bottom sides that is cantilevered from a wall, said wall bracket system comprising:

a wall leg extending angularly outward from said wall at an oblique angle and having a base end and a table support end, said base end securely affixable to said wall and said table support end extending angularly outward from said wall such that said table support end is spatially located at a point farther from said wall than said base end;

a table support leg extending outwardly from said wall leg and having a wall end attached to said table support end of said wall leg and a table adjustment end, said table support leg capable of supporting the bottom side of said table top, said table support leg having an upper surface having a notch, said notch having a cavity;

a support plate positioned proximate said table adjustment end of said table support leg and attachable to the bottom side of said table top, said support plate moveable between a first position fully above said upper surface of said table support leg, and a second position leg, and where said support plate is in said notch and an upper surface of said support plate is flush with said upper surface of said table support leg;

an adjustment means for adjusting the angular orientation of said table top relative to said wall by raising and lowering said support plate relative to said cavity, said adjustment means including a stem mounted in and rotatably engageable with said cavity and being retractable to a position such that said adjustment means is disposed fully within said table support leg; and a means for securing said table top to said surface plate.

2. The wall bracket system as defined in claim 1, wherein said surface plate is mounted upon said stem by a ball and socket assembly.

3. The wall bracket system as defined in claim 1, wherein said wall bracket system further comprises a means for measuring the relative horizontal orientation of the table support leg, said means for measuring positioned adjacent said surface plate.

* * * * *